US009935373B2

(12) United States Patent
Yang et al.

(10) Patent No.: US 9,935,373 B2
(45) Date of Patent: Apr. 3, 2018

(54) SELF-GROUNDED ANTENNA ARRANGEMENT

(71) Applicant: Gapwaves AB, Västra Frölunda (SE)

(72) Inventors: Jian Yang, Mölndal (SE); Ali Al-Rawi, Göteborg (SE); Magnus Franzén, Kungsbacka (SE); Charlie Orlenius, Göteborg (SE); Ahmed A. Kishk, St-Hubert (CA)

(73) Assignee: Gapwaves AB, Västra Frölunda (SE)

( * ) Notice: Subject to any disclaimer, the term of this patent is extended or adjusted under 35 U.S.C. 154(b) by 37 days.

(21) Appl. No.: 14/435,301

(22) PCT Filed: Sep. 30, 2013

(86) PCT No.: PCT/SE2013/051130

§ 371 (c)(1),
(2) Date: Apr. 13, 2015

(87) PCT Pub. No.: WO2014/062112

PCT Pub. Date: Apr. 24, 2014

(65) Prior Publication Data

US 2015/0380826 A1 Dec. 31, 2015

(30) Foreign Application Priority Data

Oct. 15, 2012 (SE) ..... 1251166

(51) Int. Cl.
*H01Q 1/48* (2006.01)
*H01Q 9/28* (2006.01)
(Continued)

(52) U.S. Cl.
CPC ..... *H01Q 9/28* (2013.01); *H01Q 1/48* (2013.01); *H01Q 5/25* (2015.01); *H01Q 9/26* (2013.01);
(Continued)

(58) Field of Classification Search
USPC ..... 343/702, 749, 795, 846; 29/600
See application file for complete search history.

(56) References Cited

U.S. PATENT DOCUMENTS
2,479,337 A * 8/1949 Fyler ..... H01Q 21/26 343/742
3,015,101 A 12/1961 Turner et al.
(Continued)

FOREIGN PATENT DOCUMENTS
CN 1754284 A 3/2006
DE 102005034966 A1 3/2007
(Continued)

OTHER PUBLICATIONS
Sweden Patent and Registration Office, Int'l Search Report in PCT/SE2013/051130, dated Jan. 10, 2014.
(Continued)

*Primary Examiner* — Jessica Han
*Assistant Examiner* — Hai Tran
(74) *Attorney, Agent, or Firm* — Piedmont Intellectual Property

(57) ABSTRACT

A self-grounded antenna arrangement includes a base or central portion in a first plane and a number of arm sections associated with the central portion that taper toward a respective end tip. Each arm section is adapted to form a transition from the central portion and being bent backward toward the central portion by more than 180 degrees so that its end tip approaches a first side of the central portion, at an opening in the central portion. The end tip is connected to a feeder configured to feed, via an arm-section-specific port, one specific port for each arm section. Each arm section has a mixed functionality of a curved monopole antenna and a loop antenna, and the antenna arrangement provides substantially uncoupled ports with far-field functions that are almost orthogonal in polarization, direction, or shape. The arrangement finds use in multiple-input multiple-output antenna systems for statistical multipath environments.

17 Claims, 11 Drawing Sheets

(51) Int. Cl.

| | |
|---|---|
| ***H01Q 21/24*** | (2006.01) |
| ***H01Q 5/25*** | (2015.01) |
| ***H01Q 21/00*** | (2006.01) |
| ***H01Q 9/26*** | (2006.01) |
| ***H01Q 9/40*** | (2006.01) |
| ***H01Q 9/43*** | (2006.01) |

(52) U.S. Cl.
CPC ..... *H01Q 9/40* (2013.01); *H01Q 9/43* (2013.01); *H01Q 21/0087* (2013.01); *H01Q 21/24* (2013.01)

(56) References Cited

U.S. PATENT DOCUMENTS

| | | | | |
|---|---|---|---|---|
| 5,898,405 | A | 4/1999 | Iwasaki | |
| 6,466,178 | B1 * | 10/2002 | Muterspaugh | H01Q 3/24 343/749 |
| 6,590,541 | B1 | 7/2003 | Schultze | |
| 7,075,484 | B2 * | 7/2006 | Sung | H01Q 1/243 343/700 MS |
| 7,084,830 | B1 * | 8/2006 | Suh | H01Q 1/38 343/812 |
| 2003/0025638 | A1 | 2/2003 | Apostolos | |
| 2004/0169609 | A1 | 9/2004 | Song et al. | |
| 2005/0162332 | A1 * | 7/2005 | Schantz | H01Q 13/10 343/795 |
| 2006/0055619 | A1 * | 3/2006 | Sarabandi | H01Q 7/00 343/866 |
| 2009/0046026 | A1 * | 2/2009 | Nakano | H01Q 7/00 343/741 |

FOREIGN PATENT DOCUMENTS

| | | | |
|---|---|---|---|
| JP | H07-46028 | A | 2/1995 |
| JP | 2003-249818 | A | 9/2003 |
| JP | 2011-030196 | A | 2/2011 |
| NO | 2004/077604 | A2 | 9/2004 |
| SE | 535251 | C2 | 5/2012 |
| SE | 1001072 | A1 | 5/2012 |
| WO | 2010/058942 | A2 | 5/2010 |

OTHER PUBLICATIONS

A. Lestari et al., A Modified Bow-Tie Antenna for Improved Pulse Radiation, Transactions on Antennas and Propagation, Jul. 2010, pp. 2184-2192, vol. 58, No. 7, IEEE.

Y. Mushiake, A Report on Japanese Development of Antennas: From the Yagi-Uda Antenna to Self-Complementary Antennas, IEEE Antennas and Propagation, 2004-08, pp. 47-60, vol. 46, No. 4.

P.J. Gibson, The Vivaldi Aerial, Proc. 9th Euro. Microwave Conf., Sep. 17, 1979, pp. 101-105.

M.Z. Win et al., History and Applications of UWB, Proc. IEEE, 2009-02, pp. 198-204, vol. 97, No. 2.

A.K. Amert et al., Miniaturization of the Biconical Antenna for Ultrawideband Applications, IEEE Trans. Antennas and Propagation, 2009-12, pp. 3728-3735, vol. 57, No. 12.

EPO, Supp. Euro. Search Report and Opinion, May 6, 2016, pp. 1-7.

JPO, Office Action, Jul. 4, 2017.

K. Sakaguchi, Curled Plate Antenna for UWB, Proc. 2005 IECE Comms. Soc'y Conf., Sep. 7, 2005, p. 156.

State Intellectual Property Off. P.R. China, Second Office Action, Aug. 11, 2017.

* cited by examiner

SELF-GROUNDED ANTENNA ARRANGEMENT

TECHNICAL FIELD

The present invention relates to an antenna arrangement having the features of the first part of claim 1.

The invention also relates to a method for producing an antenna arrangement.

BACKGROUND

There is an increasing demand of wideband antennas in wireless communication devices, in order to allow communication in several frequency bands and for different systems. Ultra Wide Band (UWB) signals are generally defined as signals having a large relative bandwidth (bandwidth divided by carrier frequency) or a large absolute bandwidth. The expression UWB is particularly used for the frequency band 3.2-10.6 GHz, but also for other and wider frequency bands.

The use of wideband signals is associated with many positive aspects and advantages as for example described in "History and applications of UWB", y M. Z. Win et. al, Proceedings of the IEEE, vol. 97, No. 2, p. 198-204, February 2009.

Another important aspect of the UWB-technology is that it is a low cost technology. Recent development of CMOS processors transmitting and receiving UWB-signals has opened up for a large field of different applications and they can be fabricated at a very low cost for UWB-signals without requiring any hardware for mixers, RF (Radio Frequency)-oscillators or PLLs (Phase Locked Loops).

UWB technology can be implemented in a wide range of areas, for different applications, such as for example short range communication (less than 10 m) with extremely high data rates (up to or above 500 Mbps), e.g. for wireless USB similar communication between components in entertainment systems such as DVD players, TV and similar; in sensor networks where low data rate communication is combined with precise ranging and geolocation, and radar systems with extremely high spatial resolution and obstacle penetration capabilities, and generally for wireless communication devices.

It is challenging to generate, transmit, receive and process UWB signals, since it requires the development of new techniques and arrangements within the fields of generation of signals, signal transmission, signal propagation, signal processing and system architectures.

Basically UWB antennas can be divided into four different categories. The first category comprises a so called scaled category, comprising bow-tie dipoles, see for example "A modified Bow-Tie antenna for improved pulse radiation", by Lestari et. al, IEEE Trans. Antennas Propag., Vol. 58, No. 7, pp. 2184-2192, July 2010, biconical dipoles as for example discussed in "Miniaturization of the biconical Antenna for ultra wideband applications" by A. K. Amert et. al, IEEE Trans. Antennas Propag., Vol. 57, No. 12, pp. 3728-3735, December 2009.

The second category comprises so called self-complementary structures as e.g. described in "Self-complementary antennas" by Y. Mushiake, IEEE Antennas Propag. Mag., vol. 34, No. 6, pp. 23-29, December 1992. The third category comprises travelling wave structure antennas, e.g. the so called Vivaldi antenna which is a well known and widely used antenna, as e.g. discussed in "The Vivaldi aerial" by P. J. Gibson, Proc. $9^{th}$ European Microwave conference, pp. 101-105, 1979. The fourth category comprises multiple resonance antennas like log-periodic dipole antenna arrays.

Antennas from the scaled category, the self-complementary category and the multiple reflection category comprise compact, low profile antennas with low gain, i.e. having wide and often more or less omni-directional far field patterns, whereas antennas of the travelling wave category, like the Vivaldi antennas, are directional.

The above-mentioned UWB antennas were mainly designed for use in normal Line-of-Sight (LOS) antenna systems with one port per polarization and a known direction of the single wave between the transmitting and receiving side of the communication system.

However, most environments have many objects (such as houses, trees, vehicles, humans) between the transmitting and receiving sides of the communication systems that cause reflections and scattering of the waves, resulting in a multiple of incoming waves on the receiving side. Interference between these waves causes large level variations known as fading of the received voltage (known as the channel) at the port of the receiving antenna. This fading can be counteracted in modern digital communication systems that make use of multiport antennas and support MIMO technology (multiple-input multiple-output). However, so far, there exists no wideband multiport antenna suitable for such MIMO communication systems.

Future wireless communication systems are supposed to comprise a large number of micro base stations with multiband multiport antennas enabling MIMO. Known solutions do not meet requirements as to compactness, angular coverage, radiation efficiency and polarization schemes, which all are critical issues for the performance of such systems. The radiation efficiency of a multiport antenna is reduced by ohmic losses and impedance mismatch like in single-port antennas, but also by mutual coupling between the antenna ports. Therefore, this mutual coupling should be low, but there is not known any compact multiport antenna with low mutual coupling between the ports.

The bow-tie antenna described in SE 535 251 is a single port directional UWB antenna and does not solve the problems referred to above.

SUMMARY

It is therefore an object of the present invention to provide an antenna arrangement through which one or more of the above mentioned problems can be solved. It is particularly an object to provide an antenna arrangement suitable for micro base stations for wireless communication through which multipath fading effects can be reduced. Particularly it is an object to provide an antenna arrangement which is easy and cheap to fabricate, most particularly an UWB multiport antenna for a MIMO system.

Another object is to provide an antenna arrangement, most particularly an UWB multiport antenna, which is suitable for use in measurement systems for wireless devices with or without MIMO capability, such as measurement systems based on reverberation chambers.

Therefore an arrangement as initially referred to is provided which has the characterizing features of claim 1.

Still further it is an object of the present invention to provide a method for fabrication of an antenna arrangement through which one or more of the above mentioned objects can be achieved. It is in particular an object to provide a method which is easy to carry out, which involves only low costs, which is reliable and repeatable. Therefore a method as initially referred to is provided.

Advantageous embodiments are given by the respective appended dependent claims.

Particularly a multiport antenna is provided for which the mutual coupling between the antenna ports is weak, so that the far field functions become almost orthogonal. According to the invention is particularly provided an UWB multiport antenna arrangement with a weak mutual coupling between the antenna ports ensuring far field functions that are orthogonal in some sense, such as in terms of polarization, direction or shape. With orthogonal is here meant that the inner products of the complex far field functions are low over the desired coverage of the antennas. Particularly, there is also provided an UWB antenna arrangement for measurement systems for wireless devices of wireless systems, with or without MIMO capability, which has multiple ports, with a weak coupling, particularly no coupling at all, or at least a coupling which is as low as possible between them and far field functions which are orthogonal. The invention is particularly advantageous for use in MIMO antenna systems for statistical multipath environments.

BRIEF DESCRIPTION OF THE DRAWINGS

The invention will in the following be further described in a non-limiting manner, and with reference to the accompanying drawings, in which.

DETAILED DESCRIPTION

Figure 1:
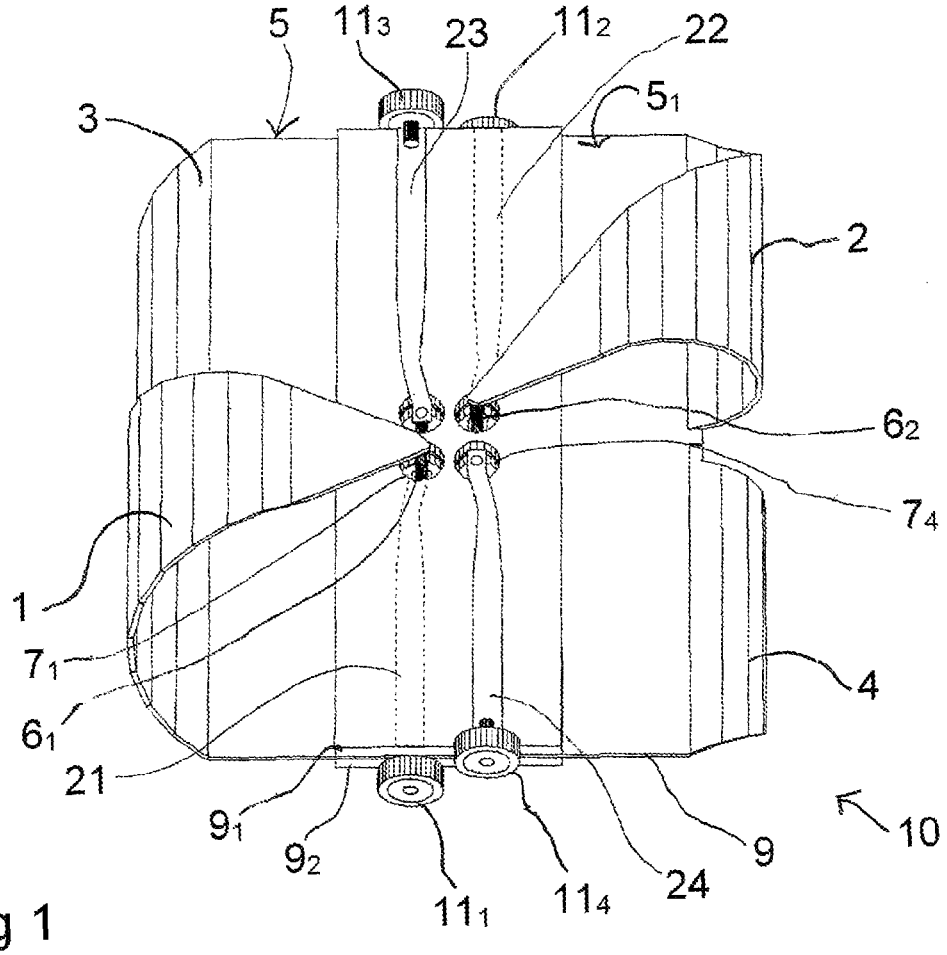
FIG. 1 is a view of an antenna arrangement according to a first embodiment of the present invention with four antenna ports.

FIG. 1 shows a first embodiment of a bow-tie antenna arrangement 10 according to the invention. The bow-tie antenna arrangement 10 comprises four arm sections 1, 2, 3, 4 which are so arranged that two arm sections 1, 2 are bent backwards towards one another on a first, here denoted upper for reasons of definition only, side $\mathbf{5}_1$ of a central portion 5. In this embodiment they are bent so that end tips of the arm sections point towards the center of said upper side $\mathbf{5}_1$. The end tips are connected to connector pins $\mathbf{6}_1$, $\mathbf{6}_2$ which via separate openings $\mathbf{7}_1$, $\mathbf{7}_2$ are connected to conductors 21, 22 (dashed lines) located on the opposite (lower) side of the central portion 5, and directed towards opposite side edges of the central portion 5.

In one advantageous embodiment the central portion comprises a circuit board with micro-strip conductors. The conductors 23, 24 of the arm sections 3, 4, which are bent backwards towards the center on the other, second, side of the central portion 5, are located on the first side $\mathbf{5}_1$ of the central portion and extend in substantially opposite directions towards outer side edges of the central portion. Ports $\mathbf{11}_1$-$\mathbf{11}_4$, here comprising coaxial connectors, are attached to the side edges, for arm sections 2, 3 on one side edge and for arm sections 1, 4 on the opposite side edge.

The central portion 5 comprises a metal layer 9, on part of the surfaces of which dielectric layers forming printed circuit boards $\mathbf{9}_1$, $\mathbf{9}_2$ are disposed. The first arm sections 1, 2 are diametrically arranged with respect to one another and are bent backwards towards the openings arranged substantially at the center of the first side $\mathbf{5}_1$ of the central portion. The second arm sections 3, 4 are diametrically and symmetrically located with respect to one another and bent backwards towards the center of the second side of the central portion.

In this embodiment the first arm section 1 and the second arm section 3 are located side by side, but bent backwards onto opposite sides or surfaces of the central portion. Correspondingly the first arm section 2 and the second arm section 4 are located side by side and bent backwards onto opposite sides or surfaces of the central portion. In this manner a very weak coupling between the ports 31, 32, 33, 34 is obtained, which is extremely advantageous for MIMO systems. Hence, although the antenna elements formed by the respective arm sections and the central portion are located very close to one another, a very low correlation between the ports is obtained, in particular embodiments even below 0.1 over the range 0.4-16 GHz, which is an extremely good performance. Particularly due to the fact that the arrangement is mainly made by a metal piece, the ohmic losses will be very low.

Figure 1A:
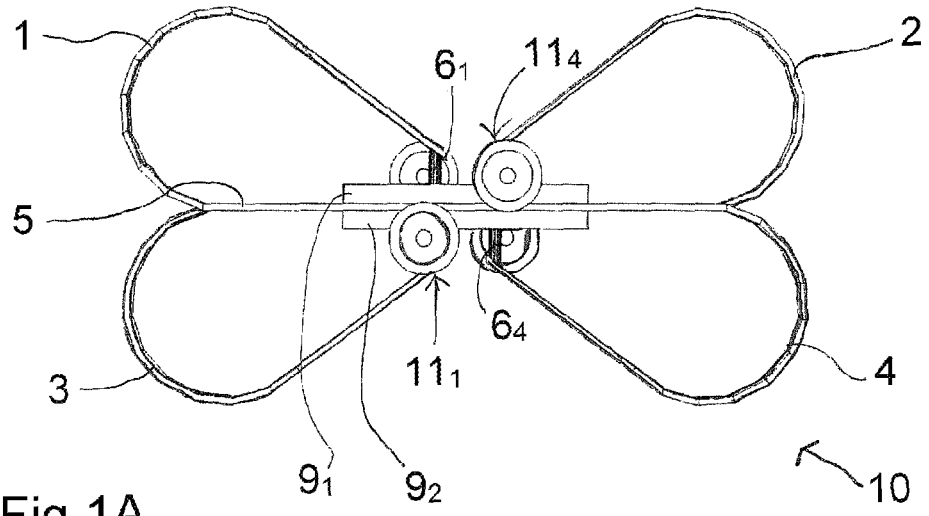
FIG. 1A is a side view of the arrangement in FIG. 1.

From the side view of the antenna arrangement shown in FIG. 1A can be seen how the first arm sections 1, 2 are bent backwards towards the first, here upper, side $\mathbf{5}_1$ of the central portion whereas the second arm portions 3, 4 are bent backwards towards the second side $\mathbf{5}_2$ of the central portion 5. The end tips of the arm sections are connected to connector pins $\mathbf{6}_1$, $\mathbf{6}_2$, $\mathbf{6}_3$, $\mathbf{6}_4$ via respective openings connecting to microstrip conductors on the respective opposite sides of the central portion.

In the embodiment of FIG. 1A the dielectric layers $\mathbf{9}_1$, $\mathbf{9}_2$ do not extend throughout the surfaces of the metal layer 9 towards the transition regions where the arm sections comprise partial extensions of the central portion. It should be clear, however, that the dielectric layers alternatively could be arranged over the entire surfaces or to any desired extent thereupon. The arrangement 10 comprises arm sections 1, 2, 3, 4, made in one piece with the central portion 5. In alternative embodiments the arm sections comprise sections which are fixedly or demountably connected to the central portion.

Figure 1B:
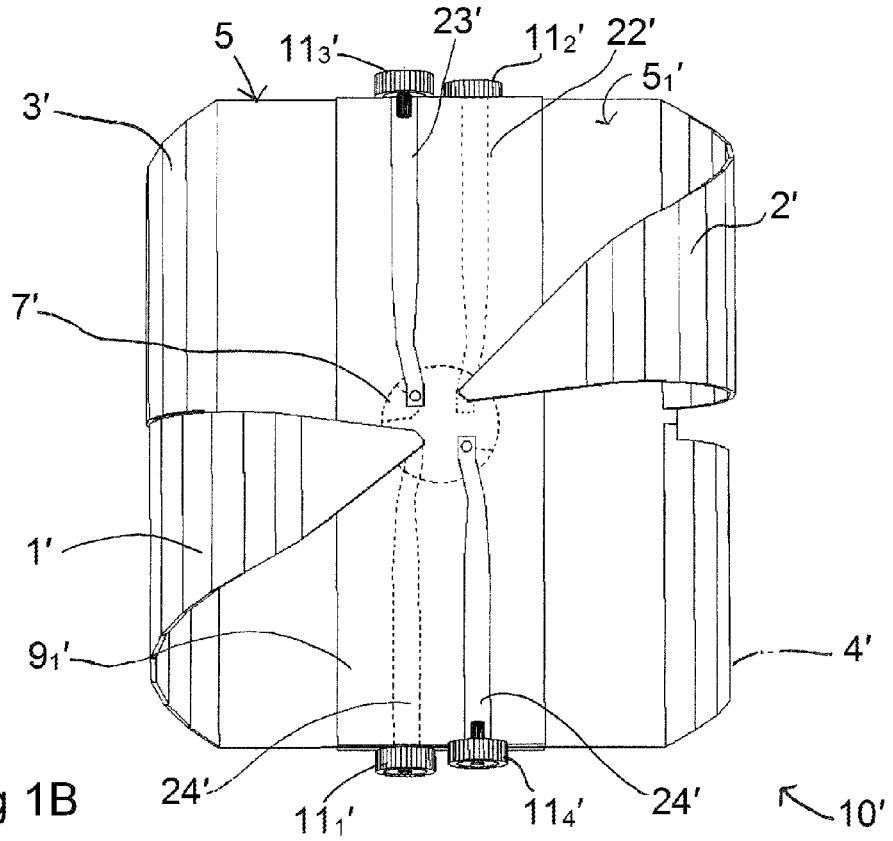
FIG. 1B shows an arrangement as in FIG. 1 which is slightly modified.

FIG. 1B shows an antenna arrangement 10' only differing from the arrangement shown in FIG. 1 in that instead of having separate openings in the central portion for each arm section connector pin, there is a common opening 7' for all connector pins. Other elements bear the same reference signs as in FIG. 1 but are provided with a prime symbol.

Figure 2:
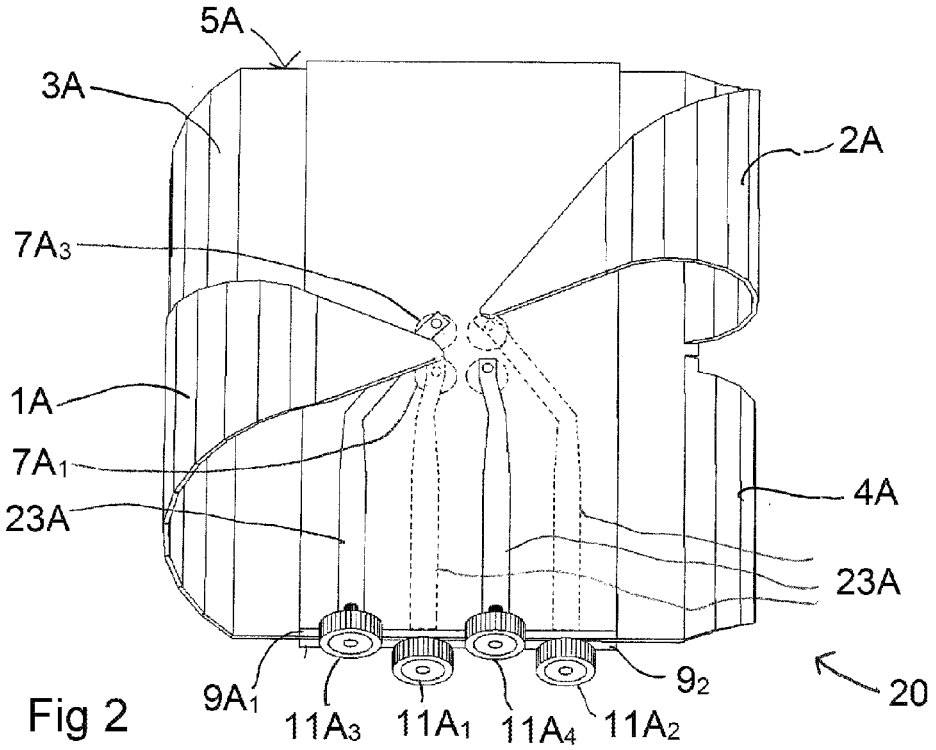
FIG. 2 shows a second embodiment of an antenna arrangement according to the invention.

FIG. 2 illustrates an antenna arrangement 20 also comprising four arm sections 1A, 2A, 3A, 4A as in FIG. 1. Elements similar to elements shown in FIGS. 1, 1A are given the same reference numerals but with an index "A". In the arrangement 20 the conductor elements 21A, 22A, 23A, 24A are all arranged to be directed towards the same side edge of the central portion 5A enabling the provisioning of connectors, e.g. coaxial connectors $\mathbf{11}A_1$-$\mathbf{11}A_4$ on one and the same outer edge of the antenna, which in some embodiments is practical for mounting and access purposes. It should be clear that instead of being edge mounted, the connectors can be mounted on the first and second sides or surfaces $\mathbf{5}A_1$, $\mathbf{5}A_2$ respectively, or in any appropriate manner; the invention is not limited to any particular type of connectors or connector locations.

Figure 3:
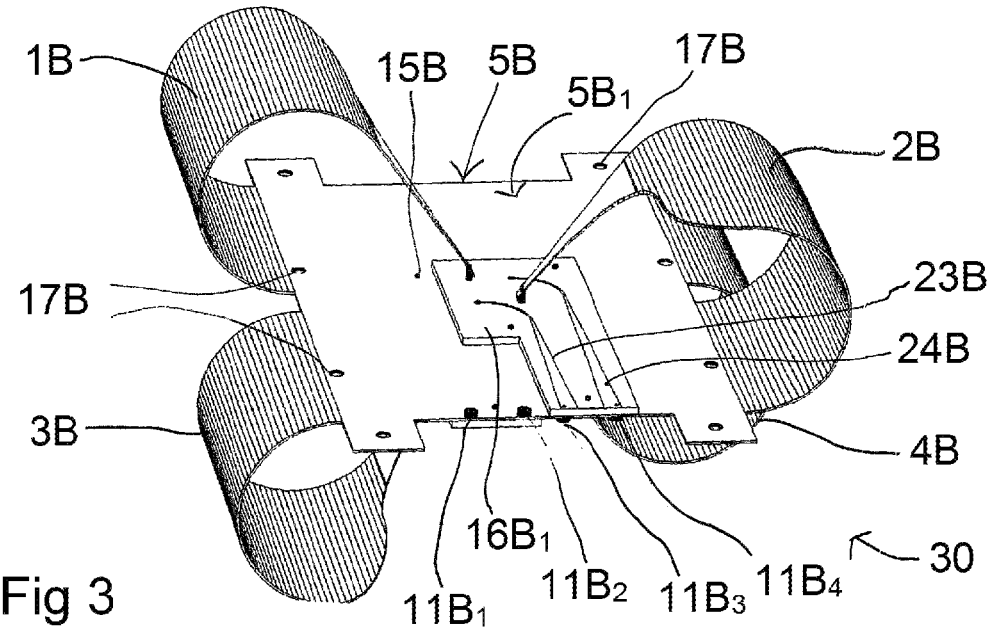
FIG. 3 is a view of a third embodiment of an arrangement according to the invention here, also with four antenna ports.

The antenna arrangement 30 shown in FIG. 3 also comprises four arm sections 1B, 2B, 3B, 4B extending from a central portion 5B which are diametrically and pairwise bent backwards onto a first side $\mathbf{5}B_1$ and onto a second side $\mathbf{5}B_2$ respectively. The arm sections have a shape tapering towards the end tips in a non-symmetric manner, starting with a rapidly tapering region after which the respective arm section is narrow and tapers regularly and approaches the central portion such that the surfaces of the narrow sections facing away from the central portion are substantially planar, and form substantially constant angles with the central portion first and second sides $\mathbf{5}B_1$ and $\mathbf{5}B_2$ respectively. The inner edges of the arm sections are in this embodiment straight, only the outer edges being irregularly tapering as described above. It should be clear that the shape of the arm sections can be chosen and optimized in different ways; only a few advantageous embodiments are shown. The two side edges of an arm section may e.g. taper symmetrically but irregularly, being straight or curved or a combination of both. In other respects similar elements that are illustrated bear the same reference signs as in FIG. 1 but with an index B.

Coaxial connectors $\mathbf{11}B_1$, $\mathbf{11}B_2$ for arm sections 1B, 2B are here provided on the first side $\mathbf{5}B_1$, and coaxial connectors 13B, 13B for arm sections 3B, 4B are here provided on the second side $\mathbf{5}B_2$. Different mounting elements 17B can be provided for in any appropriate manner in order to allow for easy and reliable mounting of the antenna arrangement wherever desired, for example on the top of a mast, at a micro base station etc. Fastening elements 15B are provided in a convenient manner for mounting circuit boards $\mathbf{16}B_1$, $\mathbf{16}B_2$.

Figure 3A:
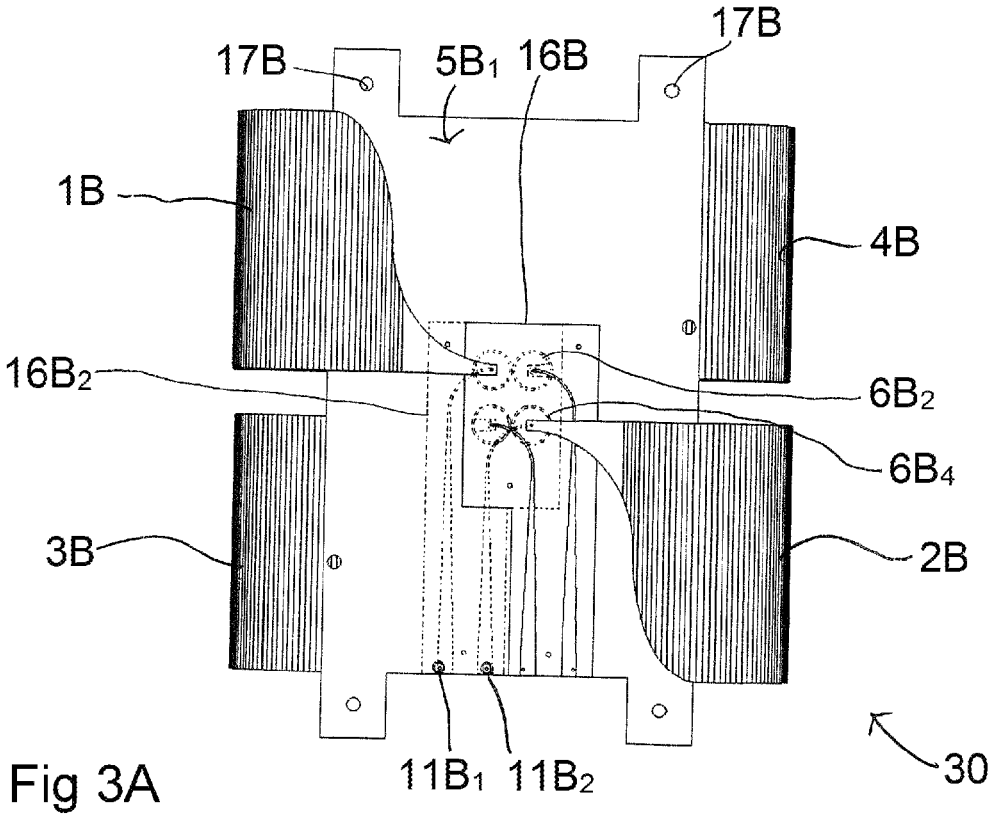
FIG. 3A is a top view of the arrangement of FIG. 3.

FIG. 3A is a top view of antenna arrangement 30 included just to show an example of an advantageous shaping of the arm sections in a clearer manner. Separate openings $\mathbf{6}B_1$-$\mathbf{6}B_4$ for the connector pins are here provided in the conducting layer of the central portion 5.

Figure 4:
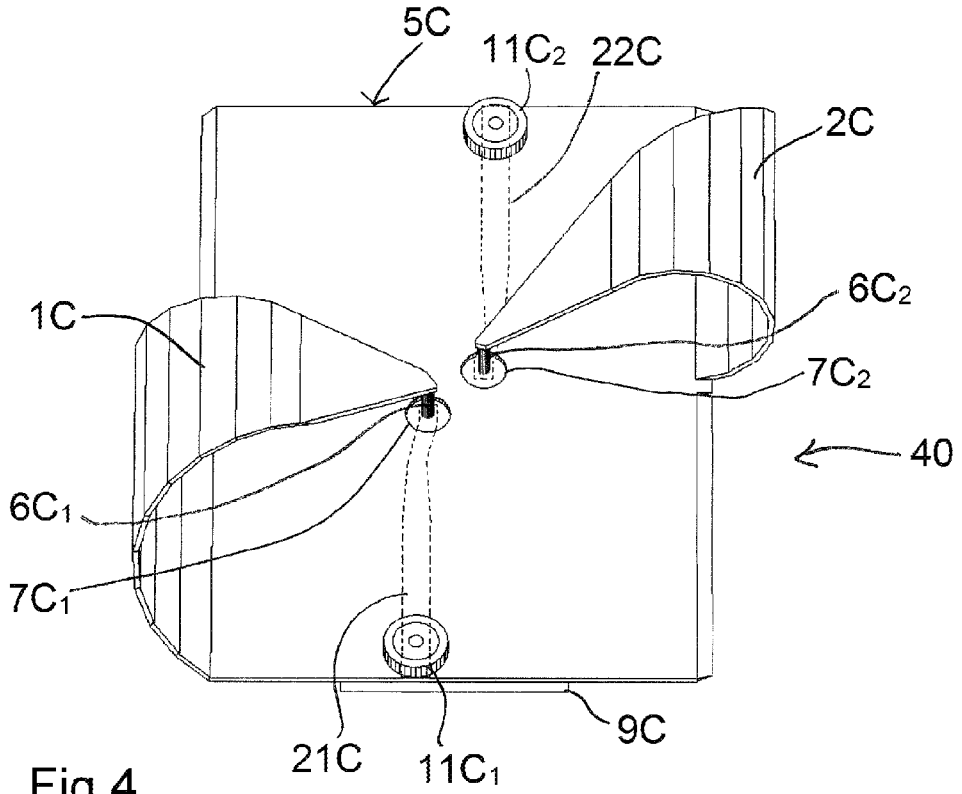
FIG. 4 is a view of a fourth embodiment comprising an antenna arrangement with two antenna ports.

FIG. 4 is an illustration of an antenna arrangement 40 with two arm sections 1C, 2C which are bent backwards towards the center of a first side of a central portion 5C such that their end tips will end at a slight diagonal distance from each other at openings $\mathbf{7}C_1$, $\mathbf{7}C_2$ through which respective conducting connector pins $\mathbf{6}C_1$, $\mathbf{6}C_2$ protrude. The connector pins $\mathbf{6}C_1$, $\mathbf{6}C_2$ are connected to microstrip lines 21C, 22C disposed on the second (here under) side of the central portion. The central portion comprises a metal plate from which the arm sections 1C, 2C protrude. The arm sections have a largest width at their ends forming extensions from the central portion, the widths being substantially half of the width of the corresponding outer edge or end of the central portion. The arm sections are disposed diametrically with respect to one another at opposite outer ends of the central portion. In this embodiment the outer edges of an arm section taper substantially symmetrically towards the end tip, although many variations are plausible. Feeding ports 11C, 12C here comprise coaxial connectors $\mathbf{11}C_1$, $\mathbf{11}C_2$ arranged at opposite edges of the central portion. Alternatively the connectors could be provided on the first side of the central portion; i.e. on the side on which the arm sections are located. A dielectric layer 9C is arranged between the metal layer of the central portion and the conductors 21C, 21C. Separate openings $\mathbf{7}C_1$, $\mathbf{7}C_2$ are provided to enable connection of the end tips with the conductors 21C, 22C. Alternatively there could be a common opening for the connector pins.

Figure 5:
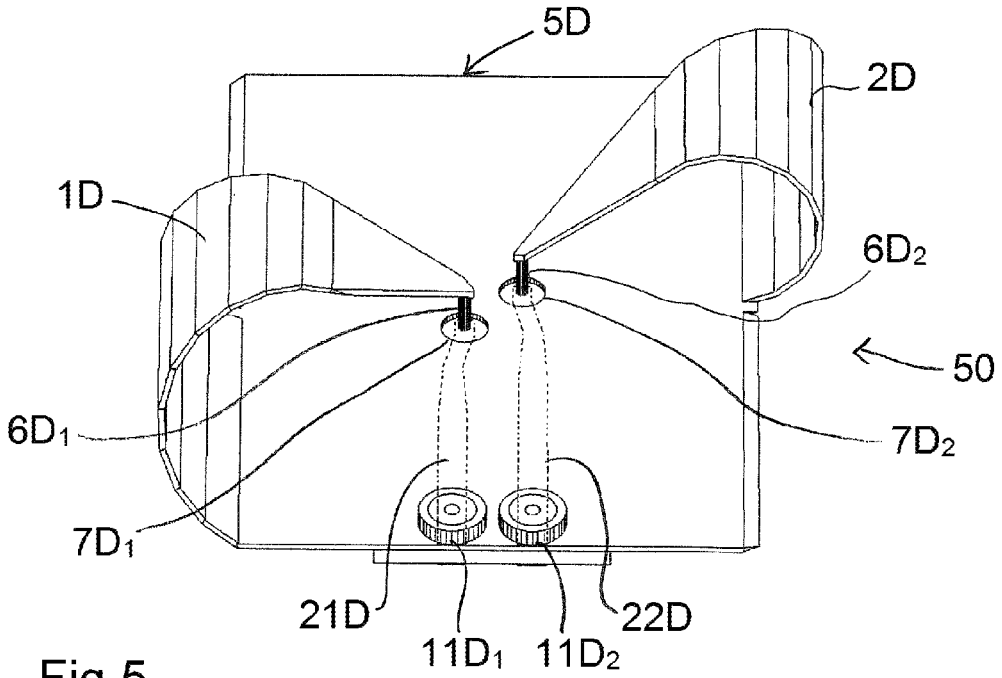
FIG. 5 is a schematic view of a fifth embodiment comprising an arrangement with two arms, FIG. 6 schematically illustrates an arrangement according to the invention suitable for mounting on a wall, FIG. 7 schematically illustrates another arrangement according to the invention which comprises two antenna structures and which is suitable for wall mounting, FIG. 8 schematically illustrates another embodiment of an arrangement comprising two antenna structures and which also is suitable for wall mounting, FIG. 9A schematically, in perspective, illustrates still another embodiment with four ports comprising an arrangement with hemi-spherical coverage suitable for mounting e.g. on a wall.

FIG. 5 shows an alternative embodiment of a self-grounded antenna arrangement 50 with two arm sections 1D, 2D. The embodiment is similar to that described with reference to FIG. 4 (similar elements bear similar reference numerals but are indexed "D"), but with the difference that the connectors $\mathbf{11}D_1$, $\mathbf{11}D_2$ are disposed close to the same outer side edge of the central portion, which is advantageous from a mounting point of view and for allowing an easy access.

Figure 6:
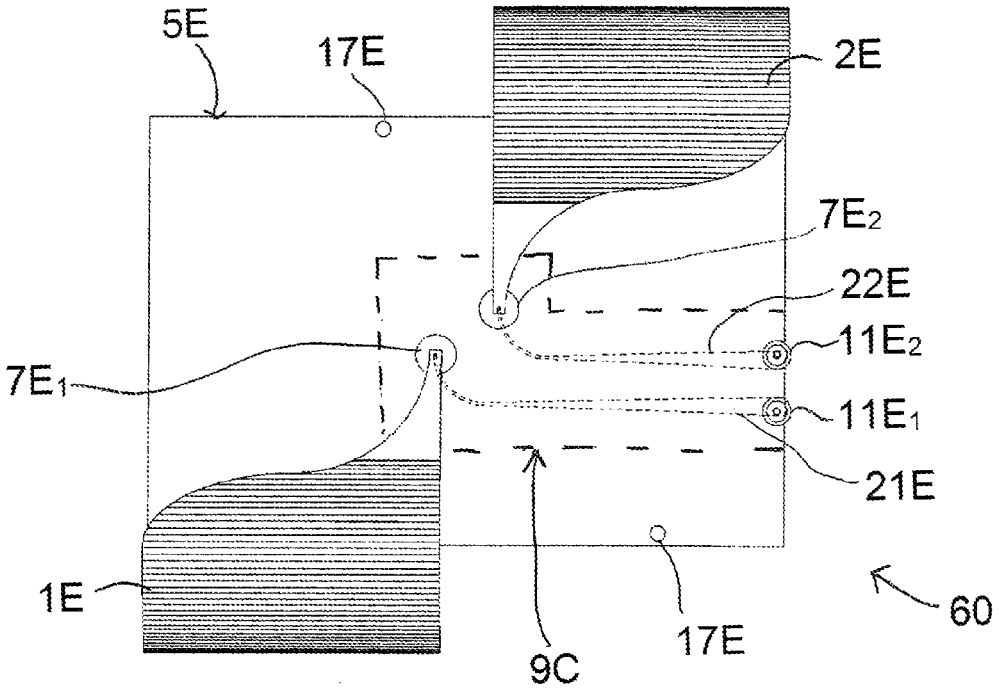

In FIG. 6 still another embodiment of an antenna arrangement 60 comprising two arm sections, forming two antenna elements, is shown. The arm sections 1E, 2E have shapes similar to the shapes of the arm sections of the arrangement shown in FIG. 3. A separate opening $\mathbf{7}E_1$, $\mathbf{7}E_2$ is provided for each of the end tips. The conductors 21E, 22E are indicated with dashed lines since they are located on the opposite side of the central portion with respect to the arm sections. Coaxial connectors $\mathbf{11}E_1$, $\mathbf{11}E_2$ are conveniently provided close to one another on the first, here upper, side of the central portion 5E as illustrated in FIG. 6.

Arrangements with two or more arm sections bent backwards onto the same side may conveniently be used for wall mounting as a wall antenna with approximately a hemispherical coverage.

Figure 7:
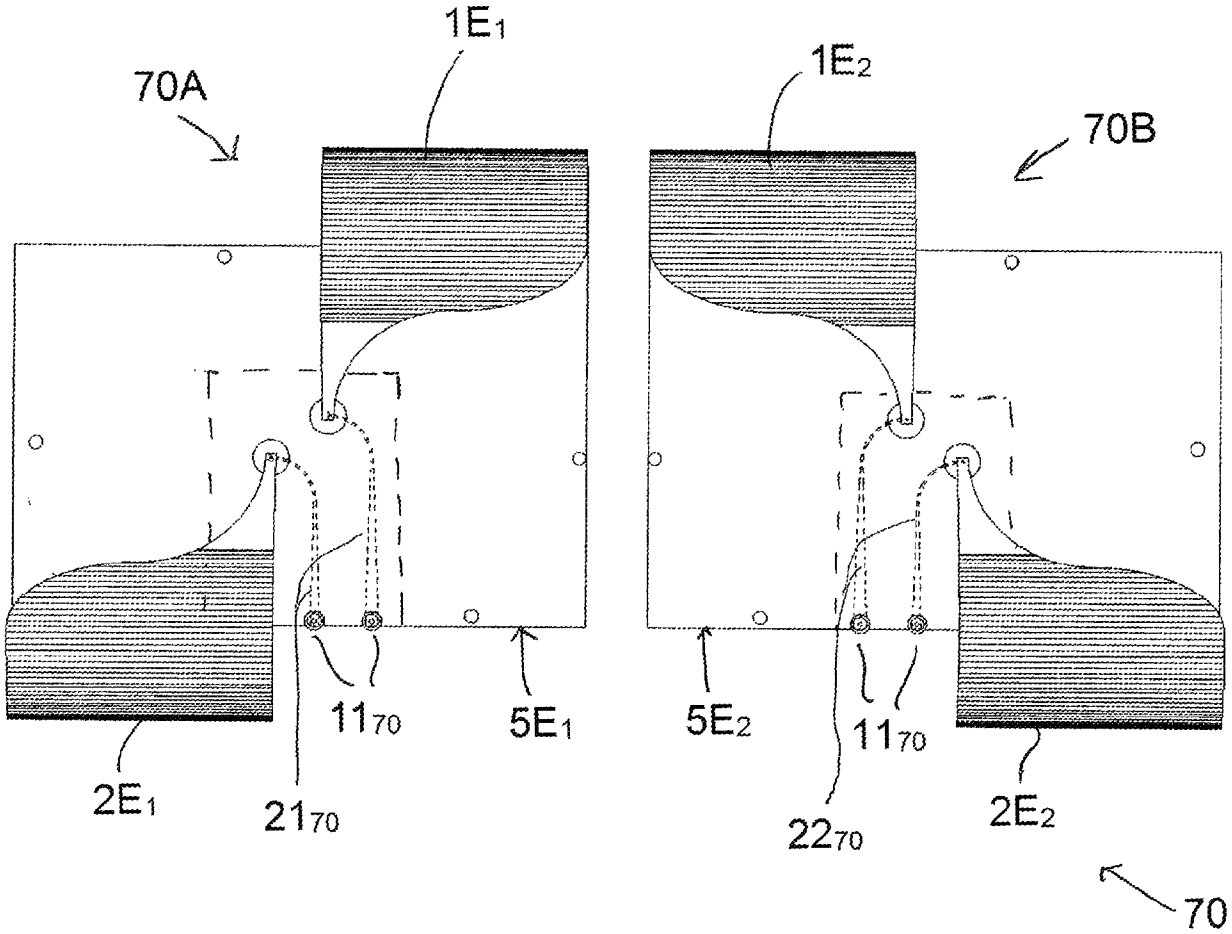

FIG. 7 shows an embodiment comprising a self-grounded antenna arrangement assembly 70 comprising two antenna arrangements 70A, 70B arranged on a common mounting frame or similar (not shown). The two antenna arrangements 70A, 70B of the assembly 70 are arranged next to each other but they have mirrored geometries as far as the positions of the arm sections are concerned such that an arm section $\mathbf{1}E_1$ of antenna arrangement 70A is arranged adjacent an arm section $\mathbf{1}E_2$ on the other antenna arrangement 70B. The connectors (ports) $\mathbf{11}_{70}$ for all arm sections are preferably arranged on one and the same side of the arrangement, although they also can be arranged in other manners.

The antenna arrangements 70A, 70B are arranged on each a separate central portion $\mathbf{5}E_1$, $\mathbf{5}E_2$, with dielectric layers $\mathbf{9}E_1$, $\mathbf{9}E_2$ disposed between respective conductors $\mathbf{21}_{70}$ and the conducting material of central portions $\mathbf{5}E_1$, $\mathbf{5}E_2$. As in previously described embodiments common openings may be used instead of separate openings in the central portions. An antenna assembly may also comprise more than two antenna arrangements.

Figure 8:
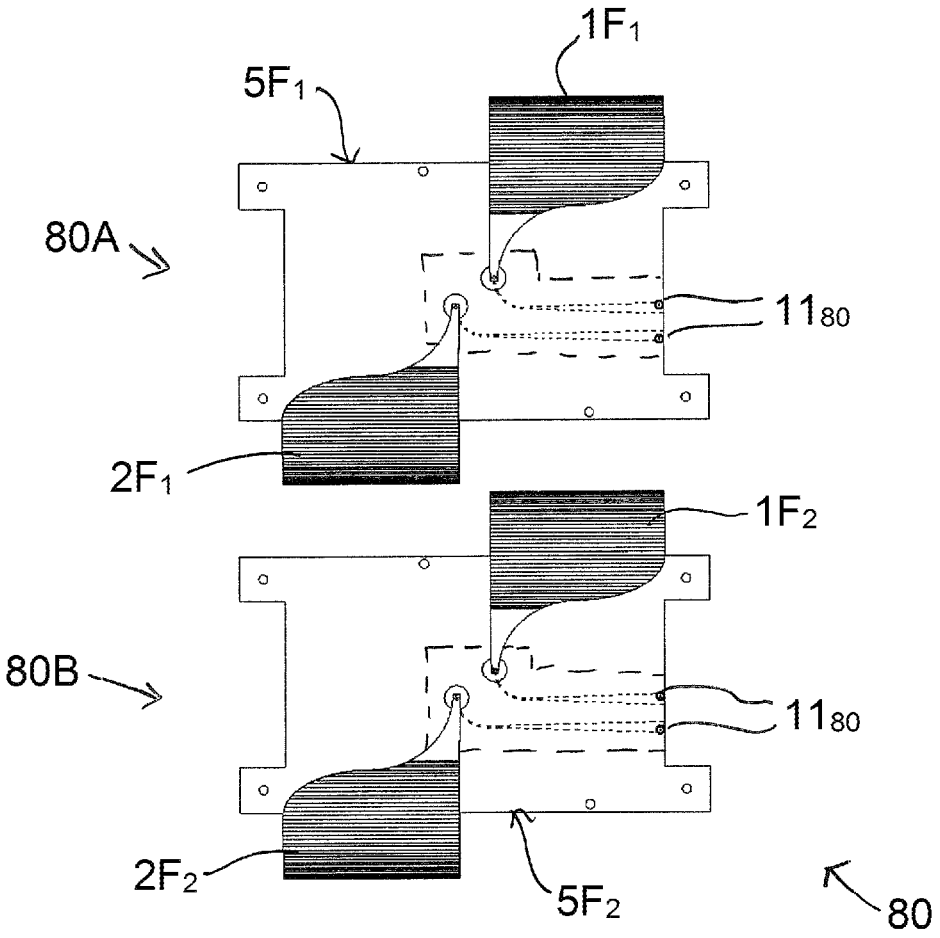

Another exemplary assembly 80 is schematically illustrated in FIG. 8, where two arrangements 80A, 80B, which are substantially identical, are disposed close to one another. The first antenna arrangement 80A comprises two arm sections $1F_1$, $1F_2$, the second antenna arrangement 80B comprises two arm sections $1F_2$, $2F_2$, the arm sections $2F_1$, $1F_2$ being arranged on adjacent edge sections of the respective central portions $5F_1$, $5F_2$ but, here, not facing one another. The four ports $11_{80}$ are arranged on the same side of the central portions of the assembly. In still another embodiment the antenna arrangement has a mirrored geometry (not shown).

It should be clear that such assemblies can be varied in many different ways as discussed in earlier embodiments, e.g. as far as the shape and tapering of the arm sections are concerned, if a common or separate openings are used for the arm sections of an arrangement, the widths and shapes of conductors may be different, where the conductors are located may differ, and the types and arrangement of connectors, as well as the arrangement of the dielectric material on the central portion may be differently implemented. Also the shape of the central portion, although preferably being square shaped or rectangular, may be different and may also have any other shape, for example triangular or hexagonal etc.

Figure 9A:
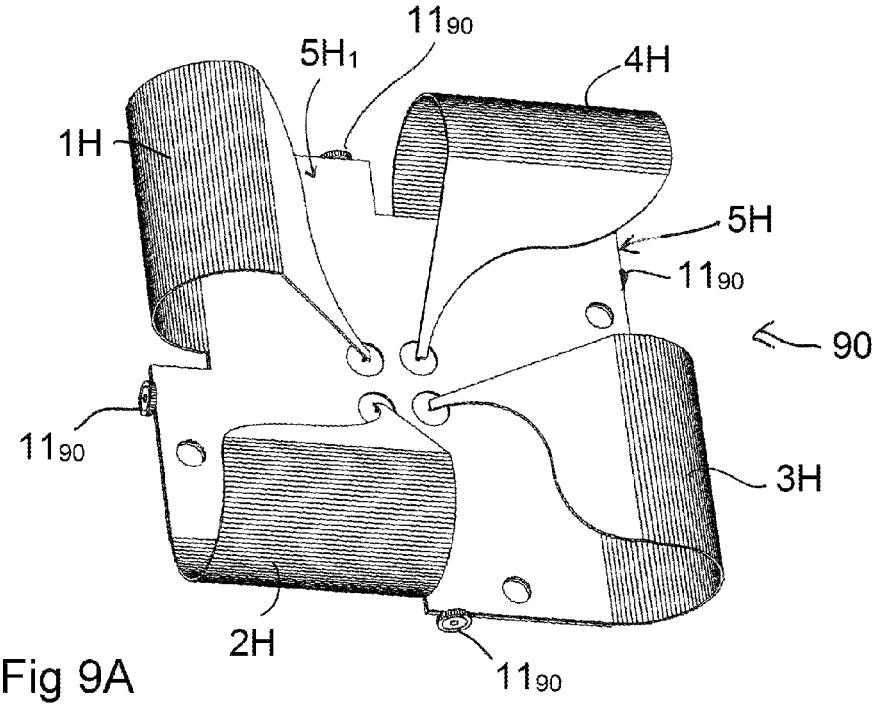
FIG. 9B is a top view of the arrangement in FIG. 9A.
Figure 9B:
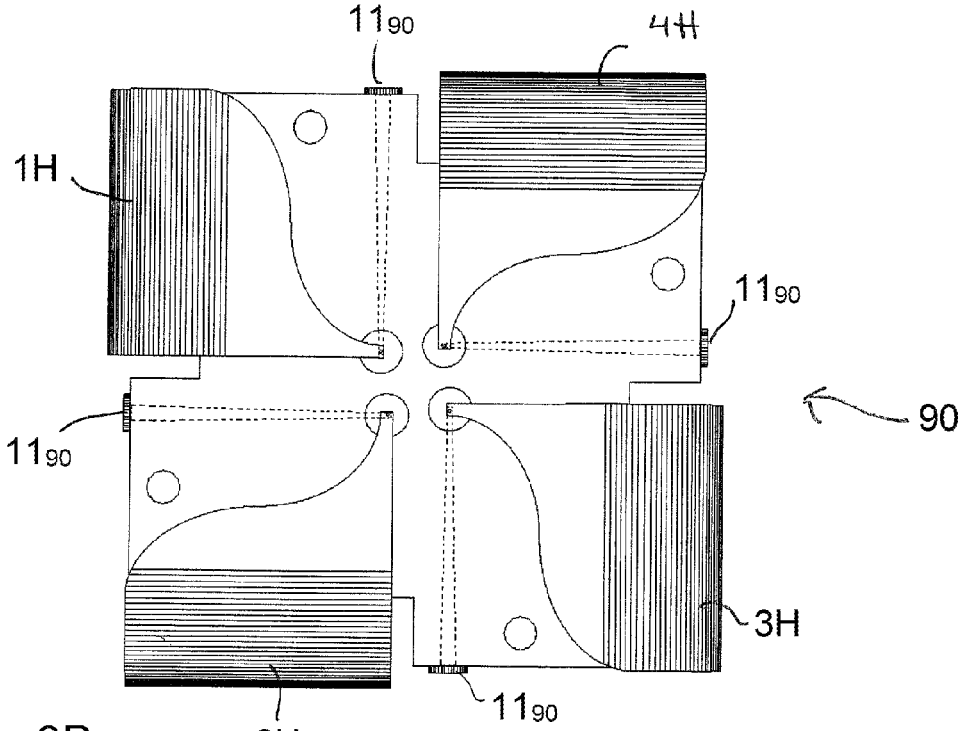

FIGS. 9A, 9B show an antenna arrangement 90 comprising a common central portion 5H with four arm sections 1H, 2H, 3H, 4H bent backwards towards the center of the same, first, side $5H_1$ of the central portion, separate openings being provided for each end tip. The conductors are indicated through dashed lines in FIG. 9B since they are located on the second, lower side of the central portion. The connectors $11_{90}$ may be disposed in different manners, one specific implementation being shown in FIGS. 9A, 9B. In other respects, shown elements are similar to elements described with reference to the preceding embodiments.

Figure 10:
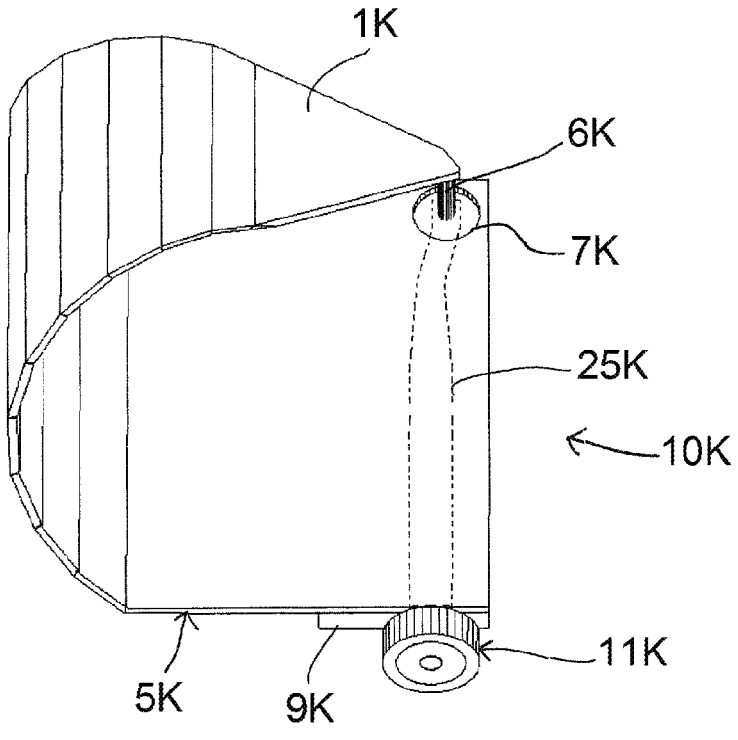
FIG. 10 illustrates an embodiment with an antenna arrangement comprising one port and a single arm section.

FIG. 10 shows an advantageous embodiment of an antenna arrangement 10K with but one single arm section 1K bent backwards towards a first side of a central portion 5K with, in this embodiment, an opening 7K in a corner thereof. The end tip of the arm section is via connector pin 6K connected to a conductor, for example a microstrip line 25K, illustrated by means of a dashed line, e.g. on a circuit board arranged on a second side of the central portion. A coaxial connector 11K is provided at an outer edge located distant from the end tip and from a transition region of the arm section from the central portion 5K. It should be clear that other conductor types can be used, as well as other types of connectors. The location for a connector may be at the first side of the central portion, or at any other appropriate location.

The arm section 1K may alternatively be bent backwards and face anywhere along the edge opposite the transition region. The central portion may also have another shape and may be larger such that the end tip instead is directed towards any other region of the central portion. The arm section may also have any other shape as discussed with reference to embodiments with two or more arm sections.

Figure 11:
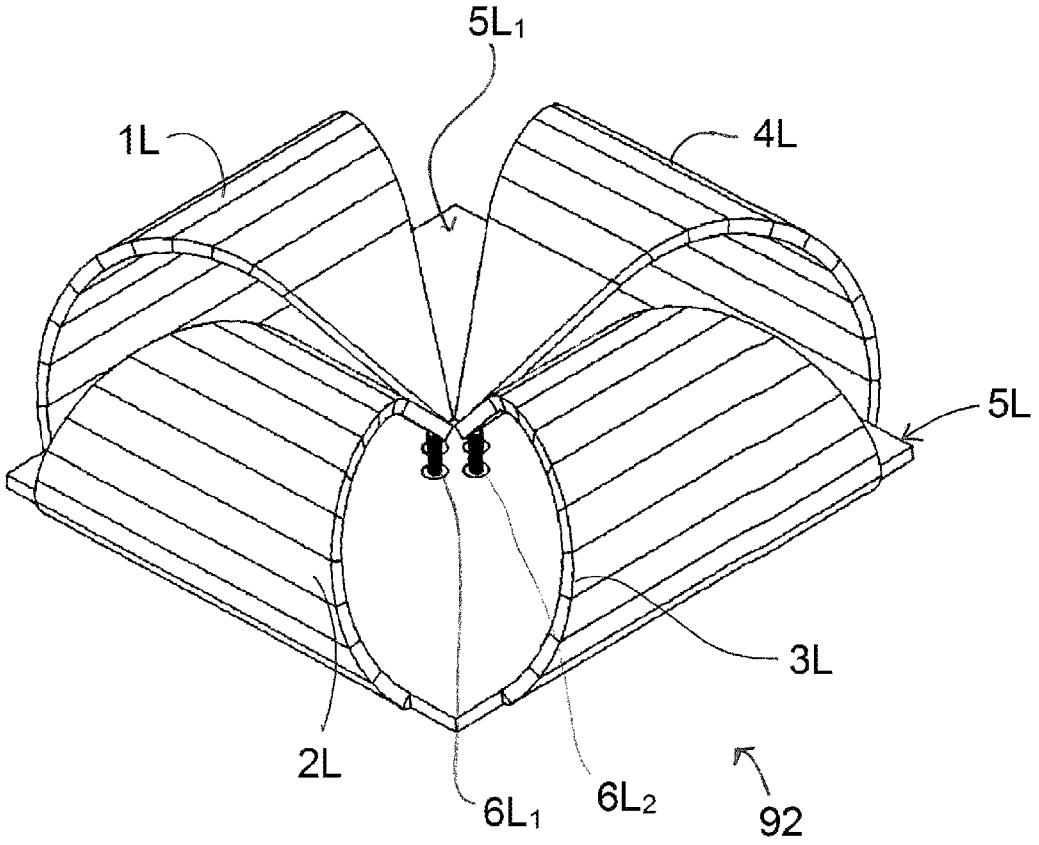
FIG. 11 shows still another embodiment of an arrangement comprising four arms and corresponding ports.

FIG. 11 schematically illustrates a non-directional antenna arrangement 92 comprising a central portion 5L with four arm sections, 1L, 2L, 3L, 4L bent backwards towards the center of the same, first, here upper, side $5L_1$, of a common central portion 5L. In the central portion 5L, separate openings are provided for the end tips of the respective arm sections 1L, 2L, 3L, 4L. Conductors (not shown) are provided in any appropriate manner on a second side opposite to said first side $5L_1$. Connectors (not shown) may be arranged in any appropriate manner as discussed with reference to the other shown embodiments.

Figure 12A:
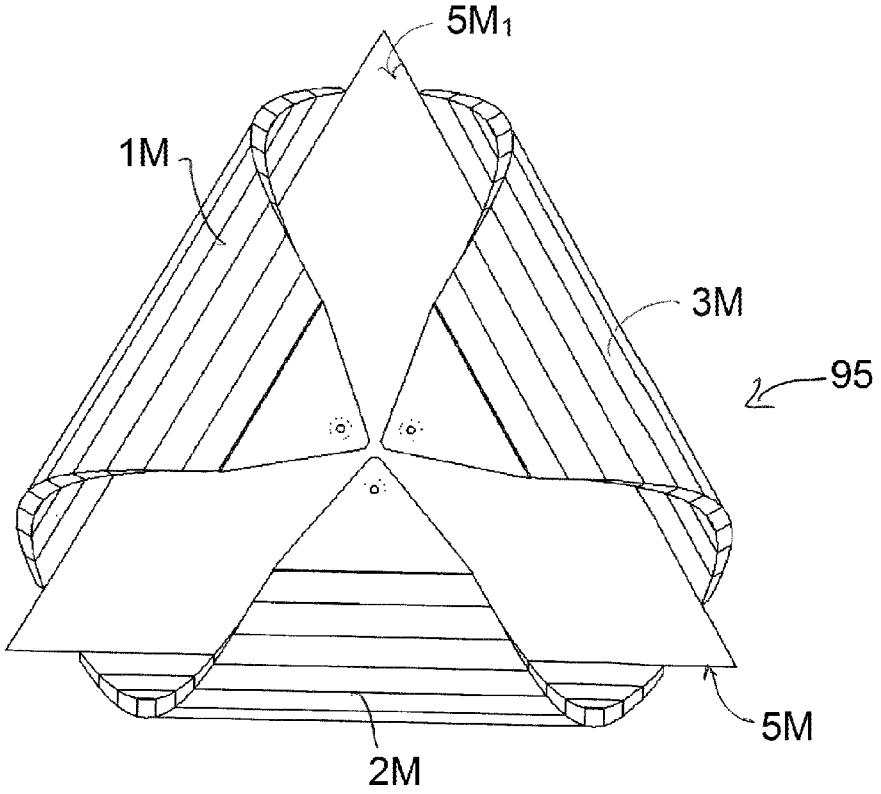
FIG. 12A is a top view of an arrangement comprising three arms and three ports.

FIG. 12A illustrates still another antenna arrangement 95 according to the invention. It comprises three arm sections 1M, 2M, 3M with a common triangular central portion 5M. The arm sections 1M, 2M, 3M comprise symmetrically tapering sections ending with a tip, which are bent backwards onto a first side $5M_1$, of the common central portion 5M, the tips pointing towards the center of the central portion and ending at a slight distance from each other and at a slight perpendicular distance from said upper side $5M_1$. Connector pins $6M_1$, $6M_2$, $6M_3$ connect the end tips, here via separate openings in the central portion 5M, with conductors (not shown) located on a second side, opposite to said first side, of the central portion. Connectors may be provided as coaxial contacts on one or more side edges of the central portion or in any other convenient manner as discussed with reference to the other illustrated embodiments.

With a three port bow-tie single polarized antenna 95 (i.e. an arrangement with three arms or bows) the coupling between arms may be even further reduced, or a low coupling between ports may be easier to achieve.

Thus, with three arms a particularly compact antenna with a low or substantially no coupling between ports can be provided, e.g. suitable for wall mounting.

Figure 12B:
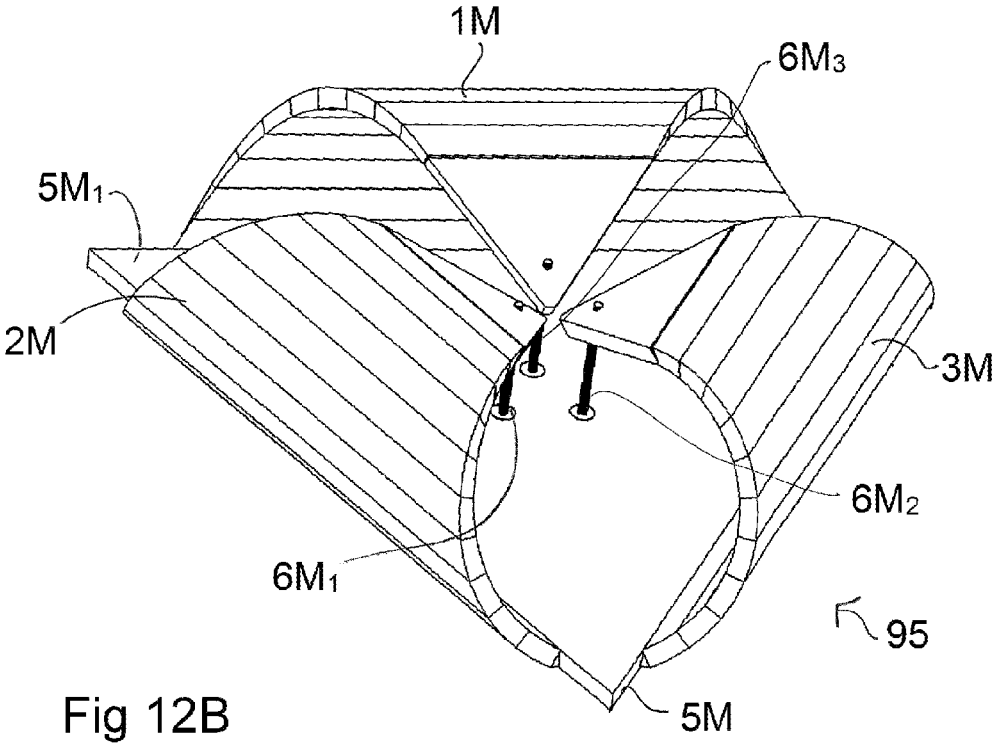
FIG. 12B is a perspective view of the arrangement shown in FIG. 12A, FIG. 13 schematically illustrates an arrangement with spherical coverage and which is suitable for mounting on a mast.

It should be clear that the arrangements shown in FIGS. 11, 12, 12A may also be provided as double sided arrangements, i.e. with two such arrangements arranged back-to-back e.g. for mounting on a mast or similar, hence providing for spherical coverage instead of a hemispherical coverage.

Figure 13:
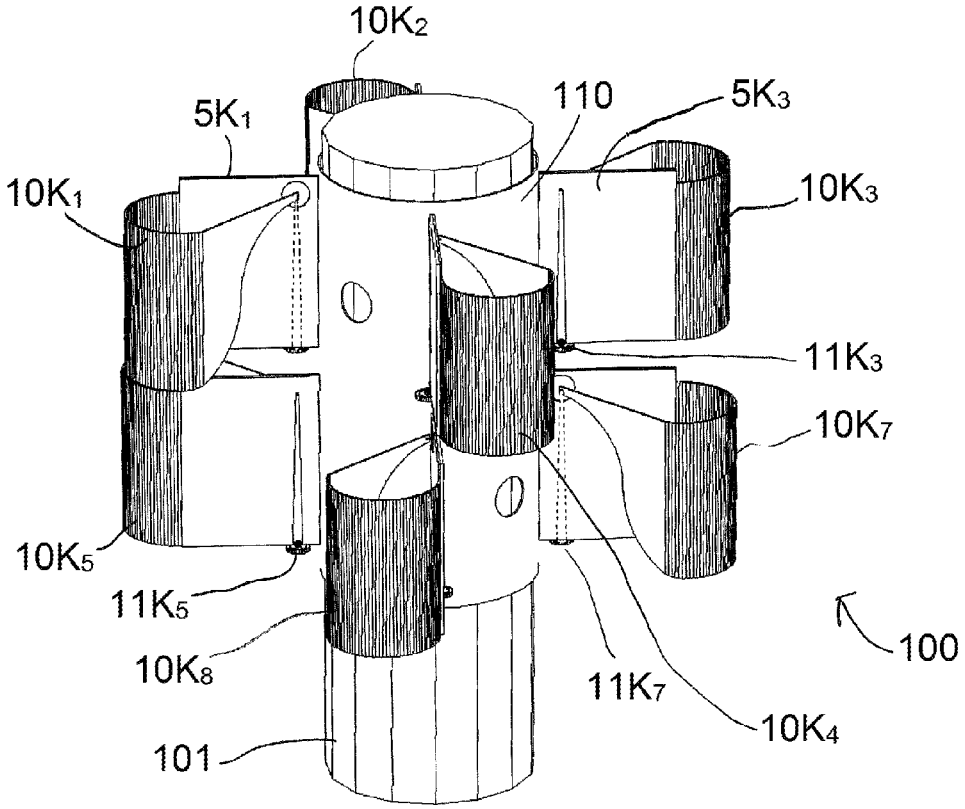
FIG. 13A is a top view of the arrangement in FIG. 13.

FIG. 13 schematically illustrates an implementation in which an arrangement 100 comprising eight separate antenna elements, for example similar to the arm sections described with reference to FIG. 10, via a mounting element 110 is mounted on the top of a mast 101. Connectors $11K_1$, $11K_2$, . . . are arranged on the edges of respective central portions $5K_1$, . . . in order to be easily accessible. In other respects the functioning is the same as that described with reference to the other shown embodiments. In alternative implementations may any other appropriate number of, e.g. three, four, ten, twelve, one-armed antenna sections be arranged on a mast. In still other embodiments, arrangements comprising e.g. two or three arm sections each may be arranged on a mast. Still further it is possible to arrange an arrangement with four or more arm sections having a common central portion on a mast.

Figure 13A:
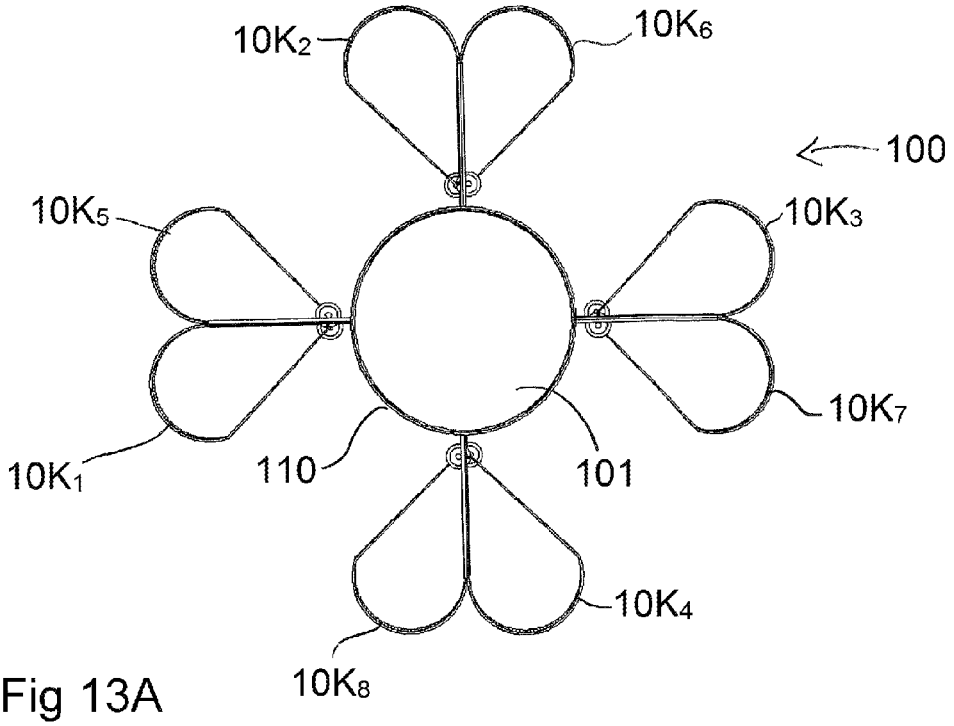

FIG. 13A is a schematic view from above of the arrangement 100 shown in FIG. 13.

It is a particular advantage of the invention that antennas with multiple ports are provided which are suitable for MIMO systems, and which are highly uncoupled (such that variations on channels will be different, avoiding that all channels have a low level at the same time).

It is particularly an advantage that an antenna arrangement is provided which is easy to fabricate, mount and control, particularly an UWB-antenna (ultra-wideband).

It is also an advantage that a MIMO antenna which is very small can be made, in some embodiments it may have dimensions corresponding to a cube with an edge length smaller than one third of the lowest operating frequency. It is also an advantage that an antenna arrangement is provided which has a low correlation between different antenna ports when it is used in a statistical field environment with multiphath, e.g. as low as 0.1 over 0.4-16 GHz in an arrangement with four arm sections (antenna elements) although they are located very close to one another. Such a low correlation can be assured by designing the multi-port antenna for having low mutual coupling measured between its ports (i.e. S-parameters $S_{mn}$, scattering parameters, smaller than typically −10 dB). It is also an advantage that a large angular coverage can be provided, by all ports together, for example 360° for some implementations, or that antenna elements easily and flexibly can be arranged so as to together provide a desired angular coverage when the received voltages on all ports are combined digitally by a so called MIMO algorithm. An example of such an algorithm is Maximum Ratio Combining (MRC).

The invention is not limited to the illustrated embodiments, but can be varied in a number of ways within the scope of the appended claims.

The invention claimed is:

1. A self-grounded antenna arrangement, comprising:

at least one central portion arranged in a first plane and configured to operate as a ground; and at least one arm section associated with the at least one central portion, each arm section tapering toward a respective end tip, comprising an electrically conducting material, being adapted to form a transition from the at least one central portion, being bent backward toward the at least one central portion by more than 180°, and having its end tip approaching the at least one central portion on a side thereof at an opening in the at least one central portion, the end tip further being adapted to be connected to a feeding port, a respective feeding port being provided for each arm section, whereby the arrangement has a mixed functionality of a curved monopole antenna and a loop antenna;

wherein the arrangement comprises at least two first arm sections; tips of the at least two first arm sections approach the at least one central portion on a same side of the at least one central portion at a distance from each other; the feeding ports for each of the at least two arm sections are substantially uncoupled such that their far-field patterns are substantially orthogonal in either polarization, direction, or shape; and the first arm sections are diametrically symmetrically disposed for reducing coupling between the feeding ports.

2. The antenna arrangement of claim 1, wherein the arrangement comprises a respective central portion for each arm section, thereby forming a combination of a single monopole antenna and a loop, each respective central portion forming a ground plane of the respective monopole antenna.

3. The antenna arrangement of claim 1, wherein the at least one central portion forms a ground plane of the arrangement, one central portion of the at least one central portion is common for a plurality of arm sections, and the at least one central portion comprises a circuit board.

4. The antenna arrangement of claim 1, wherein the arrangement comprises at least one set of three arm sections having tips which approach a central portion on a same side of the central portion, the central portion being triangular.

5. The antenna arrangement of claim 1, wherein the arrangement is an ultra-wideband antenna arrangement.

6. The antenna arrangement of claim 1, wherein the arrangement is included in a wireless communication system.

7. The antenna arrangement of claim 1, wherein the feeding ports of the first arm sections are located either on a side of the at least one central portion that is the same as the side of the at least one central portion that the first arm sections are located or on a same free outer edge of the central portion, and a central conductor connecting the tips and the feeding ports is arranged on the opposite side of the at least one central portion.

8. The antenna arrangement of claim 1, wherein the arrangement comprises at least one second arm section, the tip of which is adapted to approach the at least one central portion at a side that is opposite to the side on which the tips of the at least two first arm sections approach the at least one central portion; for the first and second arm sections, separate ports are arranged on the same or different sides of the at least one central portion or at the same or different outer edges of the at least one central portion.

9. The antenna arrangement of claim 1, wherein the arrangement is configured for attachment to a mast and has a substantially spherical combined radiation pattern.

10. The antenna arrangement of claim 1, wherein the arrangement has a substantially hemispherical combined radiation pattern.

11. The antenna arrangement of claim 1, wherein each arm section is integral with a respective central portion.

12. The antenna arrangement of claim 1, wherein an arm section comprises an element connected to a central portion.

13. The antenna arrangement of claim 1, wherein each arm section symmetrically tapers towards its end tip, with outer edges tapering along respective straight lines substantially as an isosceles triangle, bent to a location at a first distance from a first plane formed by the at least one central portion where the end tip ends from a top limiting plane at a second distance from the at least one central portion forming the first plane, the second distance being larger than the first distance.

14. The antenna arrangement of claim 1, wherein each arm section tapers towards its end tip, with outer edges tapering along curved lines, in a manner of a spherical or hyperbolic triangle, from a top limiting plane at a first distance from and parallel to a first plane formed by the at least one central portion to an end tip location at a second distance from the first plane that is smaller than the first distance.

15. The antenna arrangement of claim 1, wherein a space between the at least one central portion and either a conductor or an arm section on a respective side of the at least one central portion is filled with a dielectric material.

16. A multiple self-grounded antenna arrangement, comprising at least two antenna arrangements of claim 1, the at least two antenna arrangements being adjacent one another substantially in a same plane or along a surface and so that the feeding ports are at outer side edges of respective at least one central portions.

17. A self-grounded antenna arrangement, comprising:

at least one central portion arranged in a first plane and configured to operate as a ground; and at least one arm section associated with the at least one central portion, each arm section tapering toward a respective end tip, comprising an electrically conducting material, being adapted to form a transition from the at least one central portion, being bent backward toward the at least one central portion by more than 180°, and having its end tip approaching the at least one central portion on a side thereof at an opening in the at least one central portion, the end tip further being adapted to be connected to a feeding port, a respective feeding port being provided for each arm section, whereby the arrangement has a mixed functionality of a curved monopole antenna and a loop antenna;

wherein the feeding ports comprise coaxial connectors with center conductors that connect microstrip transmission lines to respective end tips, the microstrip transmission lines are arranged on a printed circuit board located on a side of the at least one central portion that is opposite to the side on which an arm section corresponding to the at least one central portion is bent backward, and either arm section end tips are fed via respective openings in the at least one central portion or a plurality of arm section end tips are fed via a common opening in the at least one central portion.

* * * * *